US011585345B2

(12) United States Patent
Duppert

(10) Patent No.: US 11,585,345 B2
(45) **Date of Patent: *Feb. 21, 2023**

(54) TWO-PIECE SUCTION FITTING

(71) Applicant: BITZER Kuehlmaschinenbau GmbH, Sindelfingen (DE)

(72) Inventor: Ronald J. Duppert, Fayetteville, NY (US)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/359,248

(22) Filed: Jun. 25, 2021

(65) Prior Publication Data

US 2021/0317831 A1 Oct. 14, 2021

Related U.S. Application Data

(63) Continuation of application No. 14/755,257, filed on Jun. 30, 2015, now Pat. No. 11,078,913.

(51) Int. Cl.
*F04C 18/02* (2006.01)
*F01C 21/10* (2006.01)
(Continued)

(52) U.S. Cl.
CPC ..... *F04C 29/12* (2013.01); *F01C 21/10* (2013.01); *F04C 18/0215* (2013.01);
(Continued)

(58) Field of Classification Search
CPC .... F04C 29/12; F04C 18/0215; F04C 23/008; F01C 21/10
See application file for complete search history.

(56) References Cited

U.S. PATENT DOCUMENTS 3,870,440 A 3/1975 Zuercher
5,366,352 A 11/1994 Deblois et al.
(Continued)

FOREIGN PATENT DOCUMENTS

CN 1243202 A 2/2000
CN 1400392 A 3/2003
(Continued)

OTHER PUBLICATIONS

U.S. Appl. No. 14/755,257, filed Jun. 30, 2015.

*Primary Examiner* — Deming Wan
(74) *Attorney, Agent, or Firm* — Reinhart Boerner Van Deuren P.C.

(57) ABSTRACT

A suction fitting coupled to a scroll compressor that has an outer housing with an inside diameter and a suction port defined in a wall of the outer housing. A suction duct is disposed inside the outer housing at a spaced distance from the wall of the outer housing. The suction duct defines an entrance port aligned with the suction port. The suction fitting includes a first member being generally cylindrical, and a second member being generally cylindrical. The second member is disposed inside the first member with a portion of the second member extending into the outer housing through the suction port, spanning the spaced distance to the suction duct, and coupling with the entrance port of the suction duct. Neither the first member nor the second member includes a suction screen for filtering out solid contaminants in a flow of refrigerant.

17 Claims, 4 Drawing Sheets

(51) Int. Cl.
*F04C 29/12* (2006.01)
*F04C 23/00* (2006.01)

(52) U.S. Cl.
CPC ..... *F04C 23/008* (2013.01); *F04C 2230/60* (2013.01); *F04C 2240/806* (2013.01)

(56) References Cited

U.S. PATENT DOCUMENTS

| | | | | |
|---|---|---|---|---|
| 5,547,344 | A * | 8/1996 | Sugiyama | F04C 29/124 417/32 |
| 6,171,084 | B1 | 1/2001 | Wallis et al. | |
| 6,257,846 | B1 | 7/2001 | Muramatsu | |
| 6,398,530 | B1 | 6/2002 | Hasemann | |
| 6,428,292 | B1 | 8/2002 | Wallis et al. | |
| 6,582,211 | B2 | 6/2003 | Wallis et al. | |
| 6,814,551 | B2 | 11/2004 | Kammhoff et al. | |
| 6,960,070 | B2 * | 11/2005 | Kammhoff | F04C 29/126 418/94 |
| 7,112,046 | B2 | 9/2006 | Kammhoff et al. | |
| 8,133,043 | B2 | 3/2012 | Duppert | |
| 8,167,595 | B2 | 5/2012 | Duppert | |
| 9,777,731 | B2 | 10/2017 | Bessel et al. | |
| 2003/0072662 | A1 | 4/2003 | Reinhart | |
| 2009/0041602 | A1 * | 2/2009 | Ginies | F04C 23/008 418/55.1 |
| 2009/0185932 | A1 * | 7/2009 | Beagle | F01C 21/007 418/55.2 |
| 2010/0092320 | A1 | 4/2010 | Duppert | |
| 2010/0215533 | A1 | 8/2010 | Kiyokawa et al. | |
| 2013/0248022 | A1 | 9/2013 | Roof | |
| 2015/0354567 | A1 | 12/2015 | Lin | |
| 2016/0195090 | A1 | 7/2016 | Toyama | |

FOREIGN PATENT DOCUMENTS

| | | | |
|---|---|---|---|
| EP | 0974755 | A2 | 1/2000 |
| JP | 2001-1280266 | A | 10/2001 |
| JP | 2003120539 | A | 4/2003 |

* cited by examiner

TWO-PIECE SUCTION FITTING

CROSS-REFERENCE TO RELATED PATENT APPLICATION

This patent application is a continuation, of U.S. patent application Ser. No. 14/755,257, filed Jun. 30, 2015, which is now pending, the entire teachings and disclosure of which are incorporated herein by reference thereto.

FIELD OF THE INVENTION

The present invention relates to fittings for scroll compressors for compressing refrigerant and more particularly relates to suction fitting members at the inlet of such scroll compressors.

BACKGROUND OF THE INVENTION

A scroll compressor is a certain type of compressor that is used to compress refrigerant for such applications as refrigeration, air conditioning, industrial cooling and freezer applications, and/or other applications where compressed fluid may be used. Such prior scroll compressors are known, for example, as exemplified in U.S. Pat. No. 6,398,530 to Hasemann; U.S. Pat. No. 6,814,551, to Kammhoff et al.; U.S. Pat. No. 6,960,070 to Kammhoff et al.; U.S. Pat. No. 7,112,046 to Kammhoff et al. and U.S. Pat. No. 8,167,595 to Duppert, all of which are assigned to a Bitzer entity closely related to the present assignee. As the present disclosure pertains to improvements that can be implemented in these or other scroll compressor designs, the entire disclosures of U.S. Pat. Nos. 6,398,530; 7,112,046; 6,814,551; 6,960,070, and 8,167,595 are hereby incorporated by reference in their entireties.

Additionally, particular embodiments of scroll compressors are disclosed in U.S. Pat. No. 6,582,211 to Wallis et al., U.S. Pat. No. 6,428,292 to Wallis et al., and U.S. Pat. No. 6,171,084 to Wallis et al., the teachings and disclosures of which are hereby incorporated by reference in their entireties.

As is exemplified by these patents, scroll compressors conventionally include an outer housing having a scroll compressor contained therein. A scroll compressor includes first and second scroll compressor members. A first compressor member is typically arranged stationary and fixed in the outer housing. A second scroll compressor member is moveable relative to the first scroll compressor member in order to compress refrigerant between respective scroll ribs which rise above the respective bases and engage in one another. Conventionally the moveable scroll compressor member is driven about an orbital path about a central axis for the purposes of compressing refrigerant. An appropriate drive unit, typically an electric motor, is provided usually within the same housing to drive the movable scroll member.

The present invention pertains to improvements in the state of the art.

BRIEF SUMMARY OF THE INVENTION

The present invention is directed toward a suction fitting member for a scroll compressor incorporating such a suction fitting, that may be used to bridge the distance between an inlet fitting and an internal suction duct within a scroll compressor housing.

This disclosure describes a suction fitting coupled to a scroll compressor. The scroll compressor includes an outer housing having an inside diameter and a suction port defined in a wall of the outer housing. A suction duct is disposed inside the outer housing a spaced distance from the wall of the outer housing with the suction duct defining an entrance port aligned with the suction port.

The suction fitting includes a first member and a second member with the second member configured to slide through the first member to engage the suction duct disposed in the outer housing.

The first member is generally cylindrical and has a body portion with a second inside diameter and a nose portion with a first inside diameter. The second inside diameter is larger than the first inside diameter and the nose portion is disposed in the suction port defined in the outer housing.

The second member is generally cylindrical and has a body portion with a second outside diameter and a nose portion with a first outside diameter. The second outside diameter is larger than the first outside diameter with the second member disposed inside the first member with the nose portion of the second member extending into the outer housing through the suction port and spanning the spaced distance to the suction duct. The nose portion of the second member couples with the entrance port of the suction duct. Neither the first member nor the second member includes a suction screen for filtering out solid contaminants in a flow of refrigerant.

In one embodiment, an annular land is defined inside the first member by a change of inside diameter from the second inside diameter to the first inside diameter. The annular land is configured to butt against the body portion of the second member creating an annular seal of the second member to the first member. With second member sealed against the first member and with the nose portion of the second member engaged with the suction duct, substantially all of the fluid flow into the compressor housing does not bypass the suction duct since the nose portion bridges the spaced distance between the inside wall of the outer housing and the suction duct.

In another embodiment, the change of inside diameter is defined by a curve from the second inside diameter to the first inside diameter of the first member. In another embodiment, a series of annular steps may define the change of inside diameter of the first member.

With the second member installed in the first member and engaged with the entrance port, an unimpeded fluid flow path from a distal end of the first member to the suction duct is established. With the fluid flow not impeded through the suction fitting, a reduction of pressure drop along the flow path results in an increase in compressor efficiency.

In an embodiment, the suction fitting second member is composed of sheet metal, and the suction fitting first member is a turned steel component. In certain embodiments, the first member defines a first inner-most diameter, and the second member defines a second inner-most diameter, and, to reduce a flow restriction through the suction fitting. The second inner-most diameter is at least 95% of the diameter of the first inner-most diameter.

In at least one embodiment, the flow of refrigerant is directed through an opening of the second member, the opening having a cross-sectional area of at least 5 sq. cm.

In more particular embodiments, the second member provides a limiting flow restriction, wherein, by being free of a suction screen, the limiting flow restriction is no greater than 0.5 psi gage at a flow rate of 10 cubic feet per minute (cfm) through the suction fitting. The scroll compressor may include a suction duct screen disposed in the suction duct, the suction duct screen having no contact with the suction fitting.

There is also disclosed a method for installing a suction fitting in a scroll compressor. The scroll compressor includes an outer housing having an inside diameter and a suction port defined in a wall of the outer housing. A suction duct is disposed in the outer housing a spaced distance from the wall of the outer housing. The suction duct defines an entrance port aligned with the suction port.

The method includes installing a first member of the suction fitting into the suction port. The first member is generally cylindrical and has a body portion with a second inside diameter and a nose portion with a first inside diameter. The second inside diameter is larger than the first inside diameter and the nose portion is disposed in the suction port. The nose portion extends into the wall defining the suction port.

A second member of the suction fitting is inserted into the first member with the second member being generally cylindrical and having a body portion with a second outside diameter and a nose portion with a first outside diameter. The second outside diameter is larger than the first outside diameter with the second member disposed inside the first member with the nose portion of the second member extending through the wall of the outer housing through the suction port. The nose portion is spanning the spaced distance to the suction duct and coupling with the entrance port of the suction duct. In this method, neither the first member nor the second member includes a suction screen for filtering out solid contaminants in a flow of refrigerant.

The method includes butting the body portion of the second member against an annular land defined by a change of inside diameter of the first member from the second inside diameter to the first inside diameter. In one embodiment, the change of inside diameter is defined by a curve from the second inside diameter to the first inside diameter. With the second member inserted into the first member and engaging the suction duct an unimpeded fluid flow path is established from a distal end of the first member to the suction duct with the second member installed in the first member and engaged with the entrance port.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
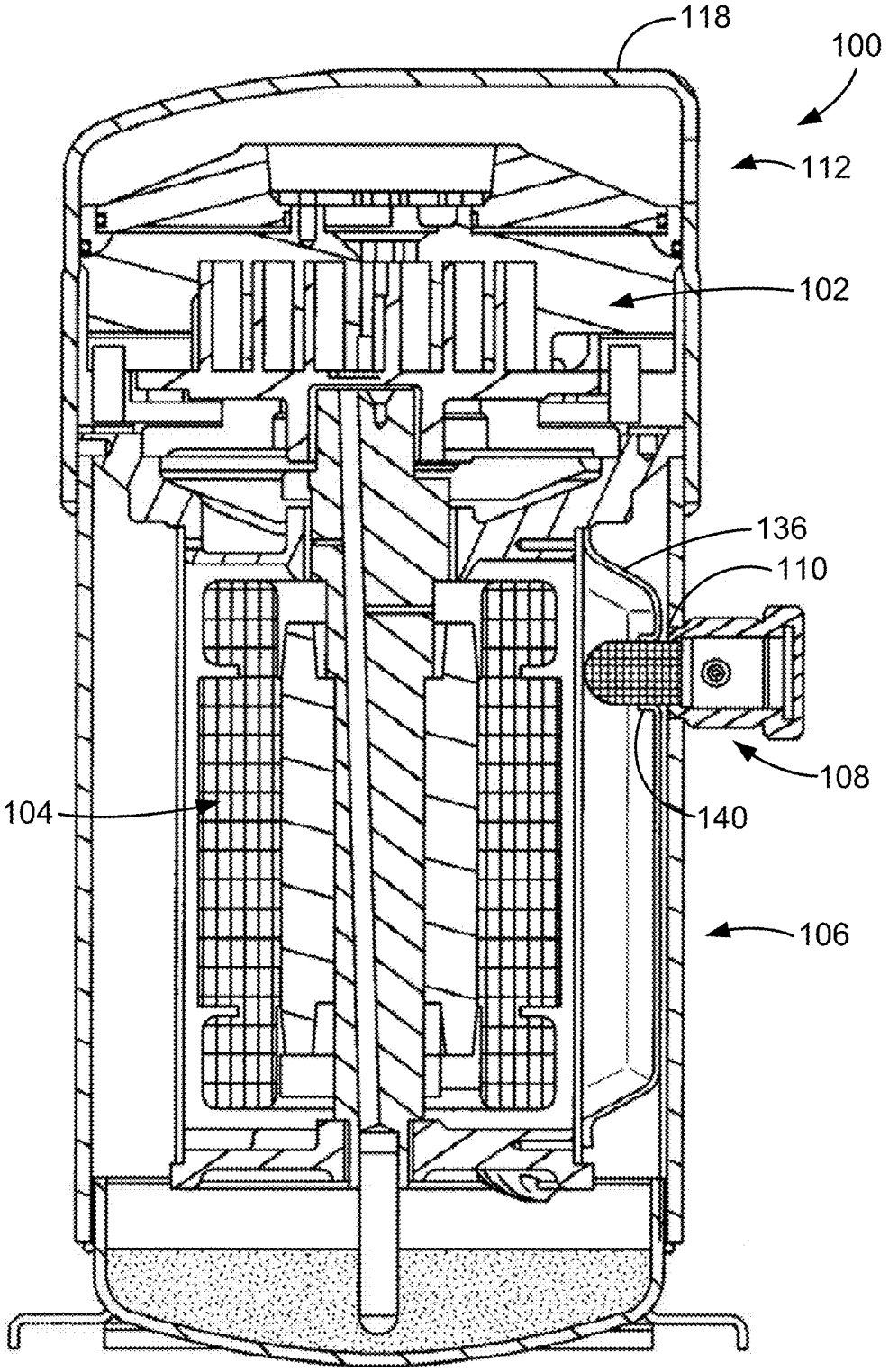
FIG. 1 PRIOR ART
FIG. 1 is a cross-section of a scroll compressor assembly in accordance with a prior art embodiment of a scroll compressor including a unitarily formed suction screen member.
Figure 2:
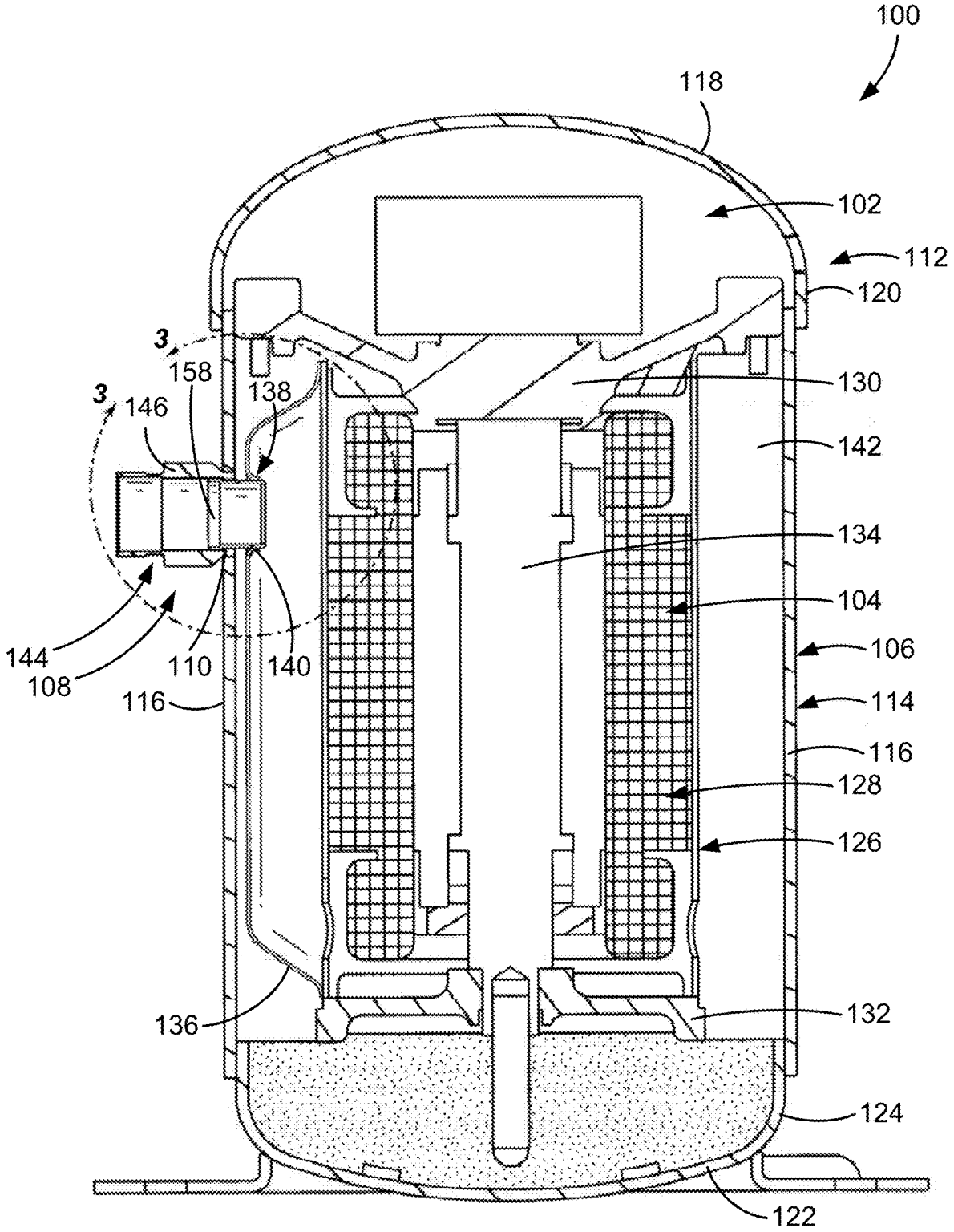
FIG. 2 is a partial cross-section and cut-away view of a scroll compressor embodiment including an exemplary embodiment of a two-piece suction fitting, without a screen member, installed in the scroll compressor housing.
Figure 3:
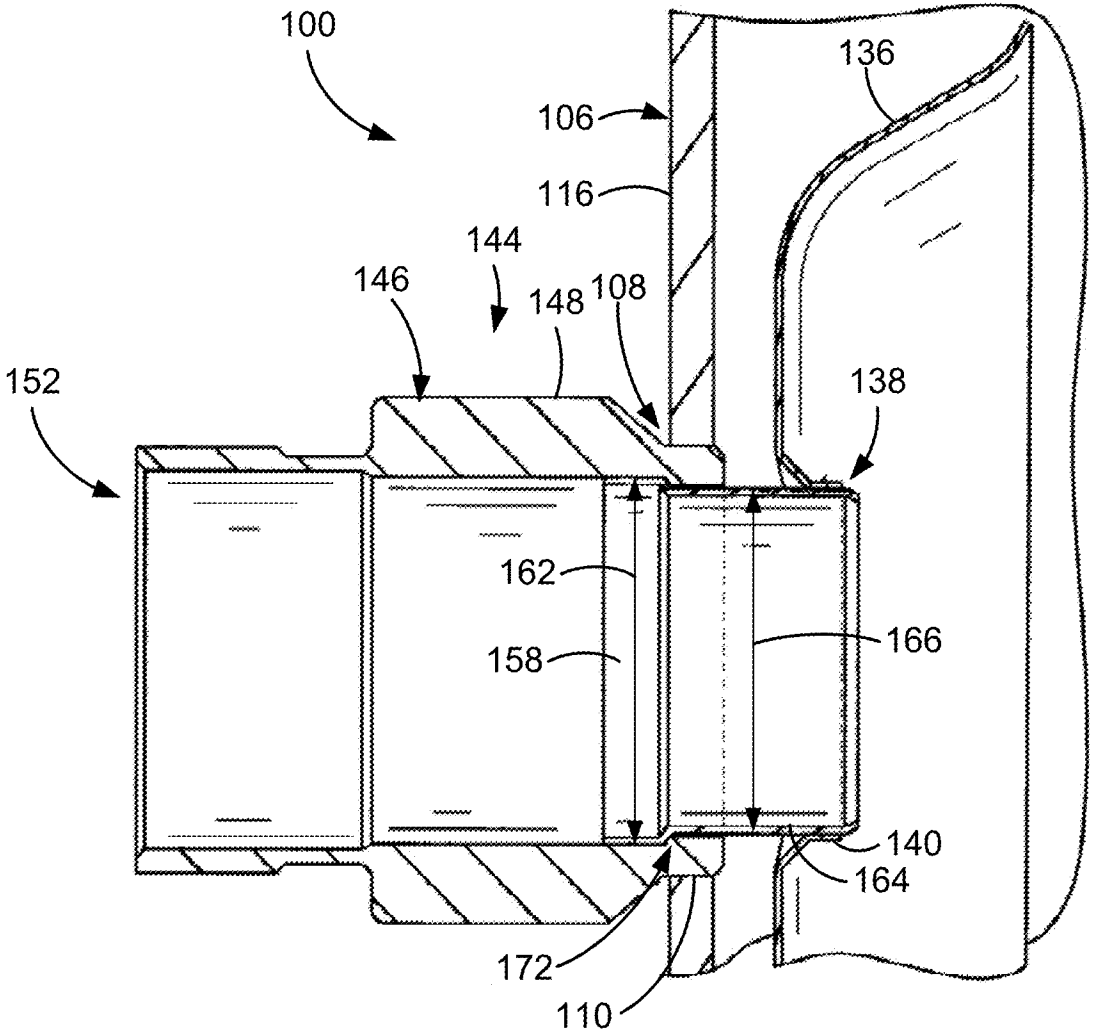
FIG. 3 is a detail cross-section of the two-piece suction fitting illustrated in FIG. 2, along the line 3-3.
Figure 4:
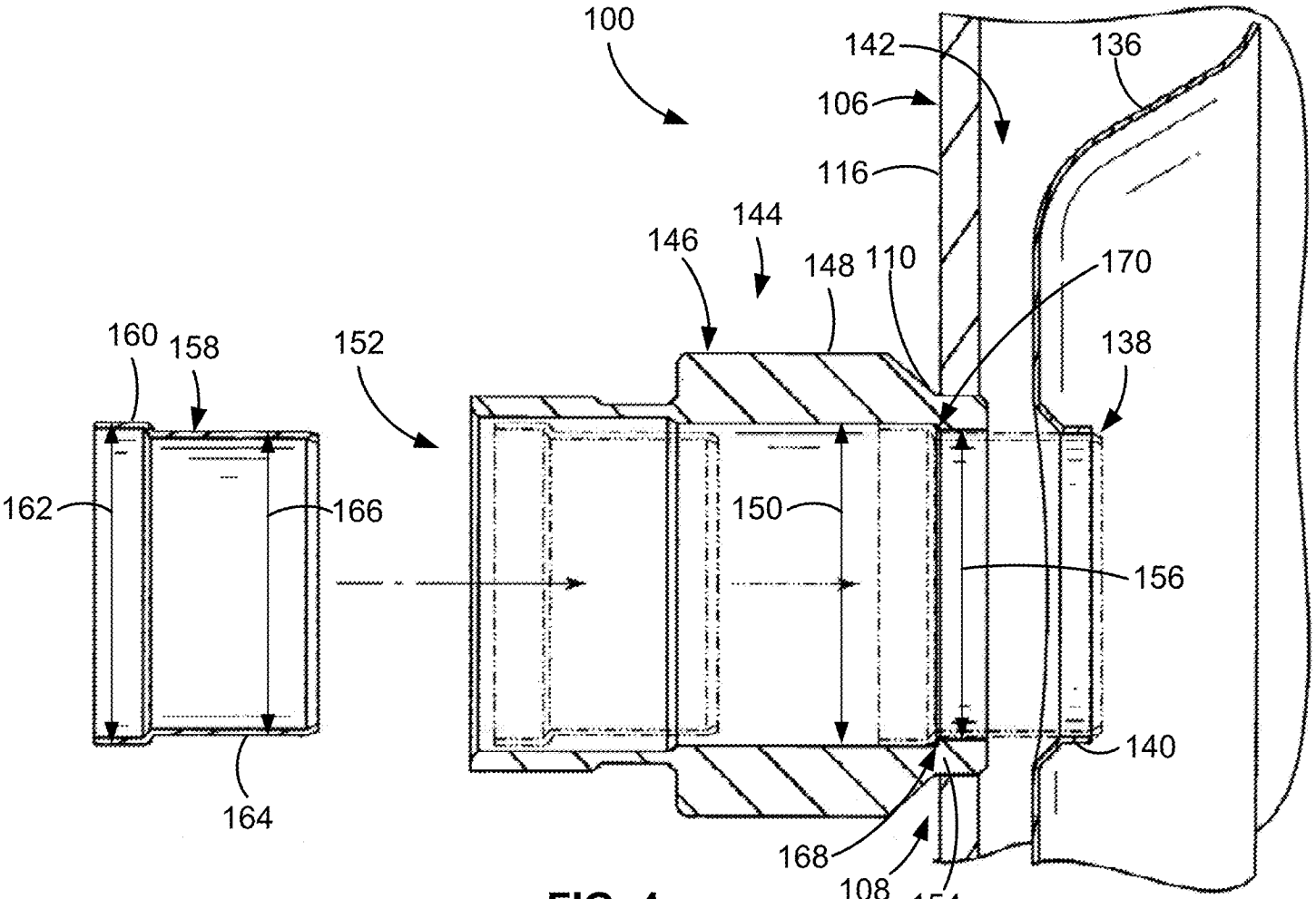
FIG. 4 is a detail cross-section of the two-piece suction fitting illustrated in FIG. 3, with a second member (in broken line) of the two-piece suction fitting being disposed inside a first member of the two-piece with a nose portion of the second member extending into the scroll compressor housing and spanning the spaced distance from the housing inside wall to a suction duct inside the scroll housing.

A prior art embodiment of a scroll compressor is illustrated in FIG. 1. An embodiment of the present invention is illustrated in FIGS. 2-4 as a scroll compressor assembly 100 generally including an outer housing 106 in which a scroll compressor 102 can be driven by a drive unit 104. The scroll compressor assembly 100 may be arranged in a refrigerant circuit for refrigeration, industrial cooling, freezing, air conditioning or other appropriate applications where compressed fluid is desired. Appropriate connection ports provide for connection to a refrigeration circuit and include a refrigerant inlet port, also referred to as a suction port 108, and a refrigerant outlet port 112 extending through the outer housing 106. The scroll compressor assembly 100 is operable through operation of the drive unit 104 to operate the scroll compressor 102 and thereby compress an appropriate refrigerant or other fluid that enters the refrigerant inlet port 108 and exits the refrigerant outlet port 112 in a compressed high-pressure state.

A scroll compressor assembly with an inlet fitting and suction screen member is disclosed in U.S. Pat. No. 8,167,595 (hereinafter "the '595 patent", issued May 1, 2012, which has been incorporated by reference. The suction screen disclosed in the '595 patent, like that shown in FIG. 1, is configured to screen out solid contaminants in the flow of refrigerant. However, the suction screen does interfere, at least to some degree, with the flow of refrigerant, which results in a pressure drop which could adversely affect the efficiency of the compressor. In some scroll compressors, a larger screen may be placed in the suction duct 136. U.S. patent application Ser. No. 14/741,137, filed Jun. 16, 2015 discloses scroll compressors having screens in the suction duct for filtering out solid contaminants from refrigerant gas. The entire teachings and disclosure of U.S. patent application Ser. No. 14/741,137 are incorporated herein by reference thereto.

In particular embodiments, the larger screen results in a lower pressure drop and increased efficiency due to a decreased interference with the flow of refrigerant. As will be shown below, embodiments of the present invention include suction fittings that do not include a suction screen. It is envisioned that these screenless suction fittings may be used in conjunction with larger screens located either in the suction duct or elsewhere within the compressor housing. This configuration typically allows for greater flow of refrigerant flow than in conventional scroll compressors having suction screens designed to fit through the inlet fitting.

The outer housing 106 may take many forms. In the preferred embodiment, the outer housing includes multiple shell sections and preferably three shell sections to include a central cylindrical housing section 114, a top end housing section 118 and a bottom end housing section 122. Preferably, the housing sections 114, 118, 122 are formed of appropriate sheet steel and welded together to make a permanent outer housing 106 enclosure. However, if disassembly of the housing is desired, other housing provisions can be made that can include metal castings or machined components.

The central housing section 114 is preferably cylindrical and telescopically interfits with the top and bottom end housing sections 118, 122. This forms an enclosed chamber 126 for housing the scroll compressor 102 and drive unit 104. Each of the top and bottom end housing sections 118, 122 are generally dome shaped and include respective cylindrical side wall regions 120, 124 to mate with the center section 114 and provide for closing off the top and bottom ends of the outer housing 106. As can be seen in FIG. 1, the top side wall region 120 telescopically overlaps the central housing section 114 and is exteriorly welded along a circular welded region to the top end of the central housing section 114. Similarly the bottom side wall region 124 of the bottom end housing section 122 telescopically interfits with the central housing section 114 (but is shown as being installed into the interior rather than the exterior of the central housing section 114) and is exteriorly welded by a circular weld region.

The drive unit 104 may preferably take the form of an electrical motor assembly 128, which is supported by upper and lower bearing members 130, 132. The motor assembly 128 operably rotates and drives a shaft 134. The electrical motor assembly 128 generally includes an outer annular motor housing, a stator comprising electrical coils and a rotor that is coupled to the drive shaft 134 for rotation together. Energizing the stator is operative to rotatably drive the rotor and thereby rotate the drive shaft 134 about a central axis.

During operation, the scroll compressor assembly 100 is operable to receive low-pressure refrigerant at the housing inlet port 108 and compress the refrigerant for delivery to the high-pressure chamber, where it can be output through the housing outlet port 112. As shown in FIG. 1, a suction duct 136 is connected internally of the housing 106 to guide the lower-pressure refrigerant from the inlet port 108 into housing and beneath the motor housing. This allows the low-pressure refrigerant to flow through and across the motor and thereby cool and carry heat away from the motor which can be caused by operation of the motor. Low-pressure refrigerant can then pass longitudinally through the motor housing and around through void spaces therein toward the top end where it can exit through a plurality of motor housing outlets that are equally angularly spaced about the central axis. The motor housing outlets may be defined either in the motor housing, the upper bearing member or by a combination of the motor housing and upper bearing member.

Upon exiting the motor housing outlet, the low-pressure refrigerant enters an annular chamber 142 formed between the motor housing and the outer housing. From there, the low-pressure refrigerant can pass through the upper bearing member through a pair of opposed outer peripheral through ports that are defined by recesses on opposed sides of the upper bearing member 130 to create gaps between the bearing member 130 and housing 106. Upon passing through the upper bearing member 130 the low-pressure refrigerant finally enters the intake area of the scroll compressor bodies. From the intake area, the lower-pressure refrigerant finally enters the scroll ribs on opposite sides and is progressively compressed through chambers to where it reaches it maximum compressed state at the compression outlet where it subsequently passes through the check valve and into the high-pressure chamber. From there, high-pressure, compressed refrigerant may then pass from the scroll compressor assembly 100 through the refrigerant housing outlet port 112.

Referring to FIGS. 2-4, it is seen that a screenless suction duct 136 is preferably employed to direct incoming fluid flow (e.g. refrigerant) from the housing inlet 108 to the stator housing. To provide for the inlet port 108, the housing includes an inlet opening 110 in which a suction fitting 144 is provided that may include a connector such as threads or other such connection means such as a barb or quick connect coupler, for example. The suction fitting 144 is welded to the housing shell in engagement with the inlet opening 110. The inlet opening 110 and the suction fitting 144 are thereby provided for communicating the refrigerant into the housing.

The suction fitting is provided to form a common bridge and thereby communicate refrigerant from the inlet 108 through the entrance opening and port 138 formed in the suction duct 136. Substantially all (in other words—all or most) of the incoming refrigerant is thereby directed through the suction fitting 144. Once passing through the suction fitting, refrigerant is then directed by the suction duct 136 to a location upstream and at the entrance of the motor housing.

Turning in greater detail to the suction duct 136, and referring to FIGS. 2-4, it is seen that the suction duct comprises a stamped sheet steel metal body having a wall thickness with an outer generally rectangular and arcuate mounting flange which surrounds a duct channel that extends between a top end and a bottom end. The entrance opening and port is formed through a channel bottom proximate the top end. This opening and port provide means for communicating and receiving fluid from the inlet 110 via a suction fitting 144 which is received through the outer compressor housing wall 116 and into duct channel of the suction duct 136.

Preferably, the suction duct 136 is a metal stamping of sheet metal to provide the body and wall structure of the suction duct 136 as a unitary member. The rectangular and arcuate mounting flange and the duct channel can readily be stamped into the sheet metal to provide an elongated duct channel and bottom grooves as well as the fastener holes. The entrance port 138 is also formed by stamping and punching out the generally circular opening from the sheet metal. Material stamp forming of the punched out area creates an annular opening flange 140 defining the entrance port 138, which projects from the channel bottom toward the mounting flange. The annular opening flange 140 tapers as it extends radially inward and away from the channel bottom of the suction duct so as to provide a tapered guide surface that facilitates insertion and assembly of the suction fitting into engagement and received within the suction duct 136.

Turning in greater detail to the suction fitting 144 with additional reference to FIGS. 2-4, the suction fitting as shown in FIG. 3, bridges the gap or spaced distance, between the inlet 108 and the internal suction duct 136. As shown, the entrance port 138 of the suction duct 136 is aligned with the inlet port 108 formed by the inlet opening 110 for the compressor housing. Preferably these openings are diametrically and concentrically aligned. The suction fitting acts as a bridging function bridging the spaced distance between the suction inlet 108 and the suction duct 136.

This disclosure describes a suction fitting 144 coupled to a scroll compressor 102. The scroll compressor 102 includes an outer housing 106 having an inside diameter and a suction port 108 defined in a wall 116 of the outer housing 106. A suction duct 136 is disposed inside the outer housing 106 a spaced distance from the wall 116 of the outer housing 106 with the suction duct 136 defining an entrance port 138 aligned with the suction port 108.

The suction fitting 144 includes a first member 146 and a second member 158 with the second member 158 configured to slide through the first member 146 to engage the suction duct 136 disposed in the outer housing 106.

The first member 146 is generally cylindrical and has a body portion 148 with a second inside diameter 150 and a nose portion 154 with a first inside diameter 156. The second inside diameter 150 is larger than the first inside diameter 156 and the nose portion 154 is disposed in the suction port 108 defined in the outer housing 106.

The second member 158 is generally cylindrical and has a body portion 160 with a second outside diameter 162 and a nose portion 164 with a first outside diameter 166. The second outside diameter 162 is larger than the first outside 166 diameter with the second member 158 disposed inside the first member 146 with the nose portion 164 of the second member 158 extending into the outer housing 106 through the suction port 108 and spanning the spaced distance to the suction duct 136. The nose portion 164 of the second member 158 couples with the entrance port 138 of the suction duct 136.

In another embodiment, an annular land 168 is defined inside the first member 146 by a change of inside diameter from the second inside diameter 150 to the first inside diameter 156. The annular land 168 is configured to butt against the body portion 160 of the second member 158 creating an annular seal 170 of the second member 158 to the first member 146. The second member 158 sealed against the first member 146 and with the nose portion 164 of the second member 158 engaged with the suction duct 136, substantially all of the fluid flow into the compressor housing 106 does not bypass the suction duct 136 since the nose portion 164 bridges the spaced distance between the inside face of the wall 116 of the outer housing 106 and the suction duct 136.

In an embodiment, the change of inside diameter is defined by a curve 172 from the second inside diameter 150 to the first inside diameter 156 of the first member 146. A series of annular steps may also alternatively define the change of inside diameter of the first member.

With the second member 158 installed in the first member 146 and engaged with the entrance port 138, and by omitting any type of suction screen on the suction fitting 144, an unimpeded fluid flow path from a distal end 152 of the first member 146 to the suction duct 136 is established. With the fluid flow not impeded through the suction fitting 144, a reduction of the pressure drop, normally associated with conventional fittings having a suction screen, along the flow path results in an increase in compressor efficiency.

In an embodiment, the suction fitting second member 158 is composed of sheet metal, and the first member 146 is composed of turned steel.

There is also disclosed a method for installing a suction fitting 144 in a scroll compressor assembly 100. The scroll compressor assembly 100 includes an outer housing 106 having an inside diameter and a suction port 108 defined in a wall 116 of the outer housing 106. A suction duct 136 is disposed in the outer housing 106 a spaced distance from the wall 116 of the outer housing 106. The suction duct 136 defines an entrance port 138 aligned with the suction port 108.

The method includes installing a first member 146 of the suction fitting 144 into the suction port 108. The first member 146 is generally cylindrical and has a body portion 148 with a second inside diameter 150 and a nose portion 154 with a first inside diameter 156. The second inside diameter 150 is larger than the first inside diameter and the nose portion 154 is disposed in the suction port 108. The nose portion 154 extends into the wall 116 defining the suction port 108.

A second member 158 of the suction fitting 144 is inserted into the first member 146 with the second member 158 being generally cylindrical and having a body portion 160 with a second outside diameter 162 and a nose portion 164 with a first outside diameter 166. The second outside diameter 162 is larger than the first outside diameter 166 with the second member 158 disposed inside the first member 146 with the nose portion 164 of the second member 158 extending through the wall 116 of the outer housing 106 through the suction port 108. The nose portion 164 spans the spaced distance to the suction duct 136 and couples with the entrance port 138 of the suction duct 136.

The method includes butting the body portion 160 of the second member 158 against an annular land 168 defined by a change of inside diameter of the first member 146 from the second inside diameter 150 to the first inside diameter 156. In one embodiment, the change of inside diameter is defined by a curve 172 from the second inside diameter 150 to the first inside diameter 156. With the second member 158 inserted into the first member 146 and engaging the suction duct 136 an unimpeded fluid flow path is established from a distal end 152 of the first member 146 to the suction duct 136 with the second member 158 installed in the first member 146 and engaged with the entrance port 138 forming an annular seal 170.

As explained above, in certain embodiments, the first member 146 has second inside diameter 150, while the second member 158 has first inside diameter 156. To reduce a flow restriction through the suction fitting 144, the first inside diameter 156 is at least 95% of the diameter of the second inside diameter 150.

In at least one embodiment, the flow of refrigerant is directed through an opening of the second member 158, the opening having a minimum cross-sectional area of at least 5 sq. cm.

In more particular embodiments, the second member 158 provides a limiting flow restriction, wherein, by being free of a suction screen, the limiting flow restriction is no greater than 0.5 psi gage at a flow rate of 10 cubic feet per minute (cfm) through the suction fitting 144. The scroll compressor 100 may include a suction duct screen disposed in the suction duct 136, the suction duct screen having no contact with the suction fitting 144.

Recognizing that there can be tolerance issues and/or assembly inaccuracies that result in slight misalignments between the suction duct and the inlet fitting in their respective openings, different means are contemplated for accommodating misalignment. For example, in the present embodiment, the second member 158 provides a surface of the nose portion 154 that helps to self locate during installation, as it can co-act with a tapered guide surface on the suction duct 136 to guide insertion. The second member 158 is configured to be closely received into complete or almost complete circular engagement with the opening flange 140 of the suction duct 136.

All references, including publications, patent applications, and patents cited herein are hereby incorporated by reference to the same extent as if each reference were individually and specifically indicated to be incorporated by reference and were set forth in its entirety herein.

For purposes of this disclosure, the term "coupled" means the joining of two components (electrical or mechanical)

directly or indirectly to one another. Such joining may be stationary in nature or moveable in nature. Such joining may be achieved with the two components (electrical or mechanical) and any additional intermediate members being integrally formed as a single unitary body with one another or the two components and any additional member being attached to one another. Such adjoining may be permanent in nature or alternatively be removable or releasable in nature.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this disclosure are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the disclosure to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A suction fitting coupled to a scroll compressor, the scroll compressor including an outer housing having an inside diameter and a suction port defined in a wall of the outer housing, and a suction duct disposed inside the outer housing a spaced distance from the wall of the outer housing, with the suction duct defining an entrance port aligned with the suction port, the suction fitting comprising:

a first member being generally cylindrical and a second member being generally cylindrical, with the second member disposed inside the first member with a portion of the second member extending into the outer housing through the suction port and spanning the spaced distance to the suction duct and coupling with the entrance port of the suction duct;

wherein neither the first member nor the second member includes a suction port screen for filtering out solid contaminants in a flow of refrigerant; and wherein the suction fitting is configured to be coupled to the entrance port of the suction duct having a screen disposed in the suction duct, wherein the screen does not contact the suction fitting.

2. The suction fitting coupled to a scroll compressor of claim 1, wherein the first member has a body portion with a second inside diameter and a nose portion with a first inside diameter, with the second inside diameter larger than the first inside diameter, and the nose portion disposed in the suction port, and the second member has a body portion with a second outside diameter and a nose portion with a first outside diameter, with the second outside diameter larger than the first outside diameter.

3. The suction fitting coupled to a scroll compressor of claim 2, further comprising an annular land inside the first member defined by a change of inside diameter from the second inside diameter to the first inside diameter, the annular land configured to butt against the body portion of the second member comprising an annular seal of the second member to the first member.

4. The suction fitting coupled to a scroll compressor of claim 3 with the change of inside diameter is defined by a curve from the second inside diameter to the first inside diameter.

5. The suction fitting coupled to a scroll compressor of claim 1, wherein the second member is installed in the first member and engaged with the entrance port, providing an unimpeded fluid flow path from a distal end of the first member to the suction duct.

6. The suction fitting coupled to a scroll compressor of claim 1, wherein each of the first member and second member is composed of metal.

7. The suction fitting coupled to a scroll compressor of claim 6, wherein the first member is turned steel and the second member is sheet metal.

8. The suction fitting coupled to a scroll compressor of claim 1, wherein the second member provides a limiting flow restriction, wherein, by being free of a suction screen, the limiting flow restriction is no greater than 0.5 psi gage at a flow rate of 10 cfm through the suction fitting.

9. The suction fitting coupled to a scroll compressor of claim 1, wherein the second member has an opening configured to receive the flow of refrigerant, the opening having a minimum cross-sectional area of at least 5 sq. cm.

10. A suction fitting coupled to a scroll compressor, the scroll compressor including an outer housing having an inside diameter and a suction port defined in a wall of the outer housing, and a suction duct disposed inside the outer housing a spaced distance from the wall of the outer housing, with the suction duct defining an entrance port aligned with the suction port, the suction fitting comprising:

a first member being generally cylindrical and a second member being generally cylindrical, with the second member disposed inside the first member with a portion of the second member extending into the outer housing through the suction port and spanning the spaced distance to the suction duct and coupling with the entrance port of the suction duct;

wherein neither the first member nor the second member includes a suction port screen for filtering out solid contaminants in a flow of refrigerant; and wherein the first member defines a first inner-most diameter, and the second member defines a second inner-most diameter, and, to reduce a flow restriction through the suction fitting, the second inner-most diameter is at least 95% of the diameter of the first inner-most diameter.

11. A method for installing a suction fitting in a scroll compressor, the scroll compressor including an outer housing having an inside diameter and a suction port defined in a wall of the outer housing, and a suction duct disposed in the outer housing a spaced distance from the wall of the outer housing, with the suction duct defining an entrance port aligned with the suction port, the method comprising:

installing a first member into the suction port, the first member being generally cylindrical; and inserting a second member into the first member, the second member being generally cylindrical and extending through the wall of the outer housing through the suction port, spanning the spaced distance to the suction duct, and coupling with the entrance port of the suction duct;

wherein neither the first member nor the second member includes a suction screen for filtering out solid contaminants in a flow of refrigerant; and wherein the suction duct has an attached screen therein, and wherein the screen does not contact the second member.

12. The method for installing a suction fitting in a scroll compressor of claim 11, wherein the step of installing the first member comprises installing the first member having a body portion with a second inside diameter and a nose portion with a first inside diameter, with the second inside diameter larger than the first inside diameter, and the nose portion disposed in the suction port, the nose portion extending into the wall defining the suction port, and wherein the step of inserting the second member into the first member comprises inserting the second member having a body portion with a second outside diameter and a nose portion with a first outside diameter, with the second outside diameter larger than the first outside diameter, with the second member disposed inside the first member with the nose portion of the second member.

13. The method for installing a suction fitting in a scroll compressor of claim 11, including butting the body portion of the second member against an annular land defined by a change of inside diameter of the first member from the second inside diameter to the first inside diameter.

14. The method of installing a suction fitting in a scroll compressor of claim 13, wherein the change of inside diameter is defined by a curve from the second inside diameter to the first inside diameter.

15. The method for installing a suction fitting in a scroll compressor of claim 11, further comprising, providing an unimpeded fluid flow path from a distal end of the first member to the suction duct with the second member installed in the first member and engaged with the entrance port.

16. The method for installing a suction fitting in a scroll compressor of claim 11, wherein each of the first member and second member is composed of metal.

17. The method for installing a suction fitting in a scroll compressor of claim 16, wherein the first member is turned steel and the second member is sheet metal.

* * * * *